US005951189A

United States Patent [19]

Winzen

[11] Patent Number: 5,951,189

[45] **Date of Patent: *Sep. 14, 1999**

[54] BINDER WITH LABEL HOLDER

[75] Inventor: Debra Winzen, Chesterfield, Mo.

[73] Assignee: American Trading and Production Corporation, Baltimore, Md.

[ * ] Notice: This patent is subject to a terminal disclaimer.

[21] Appl. No.: 09/028,849

[22] Filed: Feb. 24, 1998

Related U.S. Application Data

[63] Continuation of application No. 08/619,179, Mar. 21, 1996, Pat. No. 5,720,564.

[51] Int. Cl.[6] ..... B42F 13/00

[52] U.S. Cl. ..... 402/3; 402/70; 402/73; 402/80 R; 281/29

[58] Field of Search ..... 402/3, 70, 73, 402/80 R; 281/29, 31, 15.1, 21.1, 36, 37

[56] References Cited

U.S. PATENT DOCUMENTS 5,720,564 2/1998 Winzen ..... 402/3

OTHER PUBLICATIONS

Catalog from PaperDirect, Inc. Spring/Summer 1994, vol. 5, p. 20.

*Primary Examiner*—Frances Han
*Attorney, Agent, or Firm*—Cohn, Powell & Hind

[57] ABSTRACT

This binder (10) includes a front cover (12), a rear cover (14) and a spine (16) and is provided with a transparent label holder (50) which extends across the spine (16) and is attached to at least one of the covers (12,14). The label holder (50) provides an open upper margin (52) and is attached at the side margins (60, 62) and at least partially attached at the lower margin (54) to retain the label (100) which thereby has an increased area for label information.

11 Claims, 3 Drawing Sheets

BINDER WITH LABEL HOLDER

This application is a continuation of application Ser. No. 08/619,179, filed on Mar. 21, 1996, now U.S. Pat. No. 5,720,564.

BACKGROUND OF THE INVENTION

This invention relates generally to binders and particularly to an improved labeling system for the binder.

In general, the contents of binders, and the like, are identified by a label attached to the spine and/or front cover. In the former attachment the identifying data is readily visible when the binder is vertically placed in a bookcase or spine upper most in a hanging file and in the latter when the binder is laid flat. Conventionally, such labels are of two types. The first type of label consists of a simple rectangle of paper on which the identification data can be applied and the label then adhesively attached to the spine or front cover. The second type of label consists of a rectangle of transparent material which is either heat sealed to the spine or front cover of the binder or is adhesively attached to the spine or front cover of the binder to provide a pocket into which a label bearing identification data can be inserted. In both cases, where the spine label is used, the label is narrower than or substantially the same width as the spine. In the first case the paper label is prone to becoming detached from the spine. In the second case it is frequently difficult to insert the thin paper label into the pocket between the seals and they often require trimming. Also where additional information is desired on the binder it may be necessary to use both spine and cover labels.

Also known in the prior art is the provision of a clear overlay multi-label holder extending the combined widths of the binder, i.e., the front, back and spine. This holder is sealed on both side edges and the bottom and also at the fold lines defining the spine. This arrangement, in effect, defines three label holding areas one being the width of the spine and the other being the width of the front and back covers. Because this label holder is sealed along both of the spine fold lines the arrangement does not permit the use of a single label which extends continuously between the spine and one or both of the covers, nor does this arrangement permit the use of a standard 8½ inches 11 inches sheet as a label which embraces the spine area.

The present label overcomes these problems in a manner not revealed in the known prior art.

SUMMARY OF THE INVENTION

This improved binder labeling system is wider than the width of the spine and provides a pocket or label holder into which a relatively large sheet of identification material can be readily inserted.

A label holder of transparent material is provided which is not limited to the width of the spine and may be adapted to suit a sheet of paper of conventional size. For example, 8½ inches by 11 inches capable of bearing data in addition to the identification data on the spine and allows for custom computerized copy using a single label insert. This permits information to be carried on the front and back of the binder as well as the spine and is possible because the label holder is free of attachment in the vicinity of at least one of the fold lines defining the spine.

This binder with label holder comprises a front cover means, a rear cover means and a spine means connecting said front and rear cover means and defined by fold lines; and a holder means including a sheet of transparent material having an upper margin, a lower margin and opposed side margins, at least one of said holder side margins being attached to one of said cover means and the other of said side margins being attached to one of said other cover means and spine means and the holder means being substantially free of attachment to the binder in the vicinity of at least one of said fold lines, one of said upper and lower margins being open to receive a label.

It is an aspect of this invention to provide that said upper margin is open to receive a label having a width greater than the width of the spine means.

It is another aspect of this invention to provide that said lower margin is at least partially attached to at least one of said cover means to provide a stop for said label.

It is yet another aspect of this invention to provide that one of said opposed side margins is attached to said front cover means in spaced relation from said spine means and the other of said side margins is attached to said rear cover means in spaced relation from said spine means.

It is still another aspect of this invention to provide that said side margins are attached to their associated cover means substantially equidistant from said spine means.

It is another aspect of this invention to provide that said lower margin ends are attached to associated cover means to provide a stop for said label.

It is yet another aspect of this invention to provide that said label is of a conventional paper size.

It is still another aspect of this invention to provide that the binder is of a size to receive a conventional size of paper and the label is the same size as said binder paper.

It is another aspect of this invention to provide that the binder is polyethylene and the sheet of transparent material is polyethylene film having the side margins attached to the front and rear cover means by heat sealing.

It is an aspect of this invention to provide a holder means having a first pair of opposed margins and a second pair of opposed margins and a width greater than the spine means; both of said one pair of opposed margins being attached to said cover means and at least one of said margins of the other pair of margins being open to receive a label.

It is yet another aspect of the invention to provide that the upper and lower margins of the holder are attached and at least one of the side margins is open to receive a label.

This identifying label is inexpensive to manufacture, easy to use and particularly effective for its intended purpose.

DESCRIPTION OF THE PREFERRED EMBODIMENT

Figure 1:
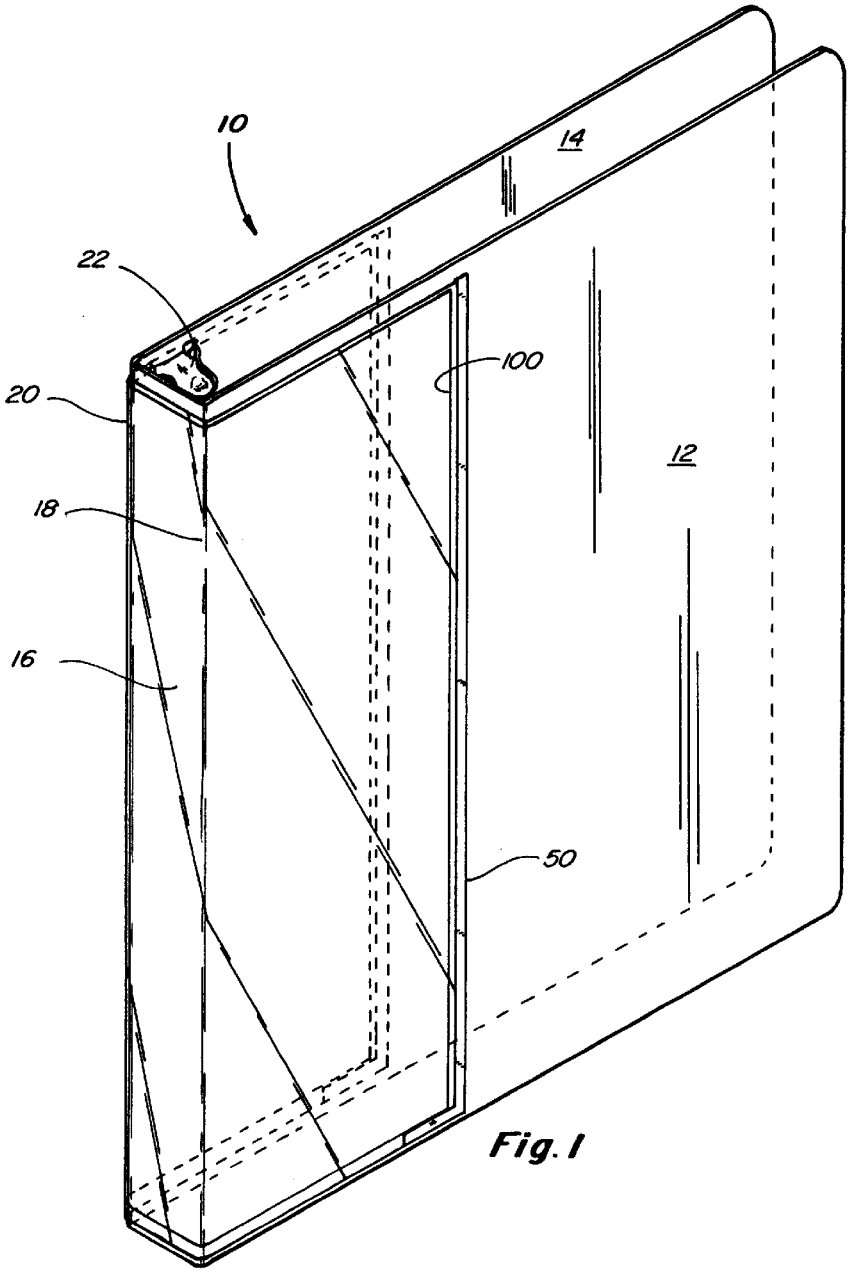
FIG. 1 is a perspective view of a binder incorporating the improved labeling system.
Figure 2:
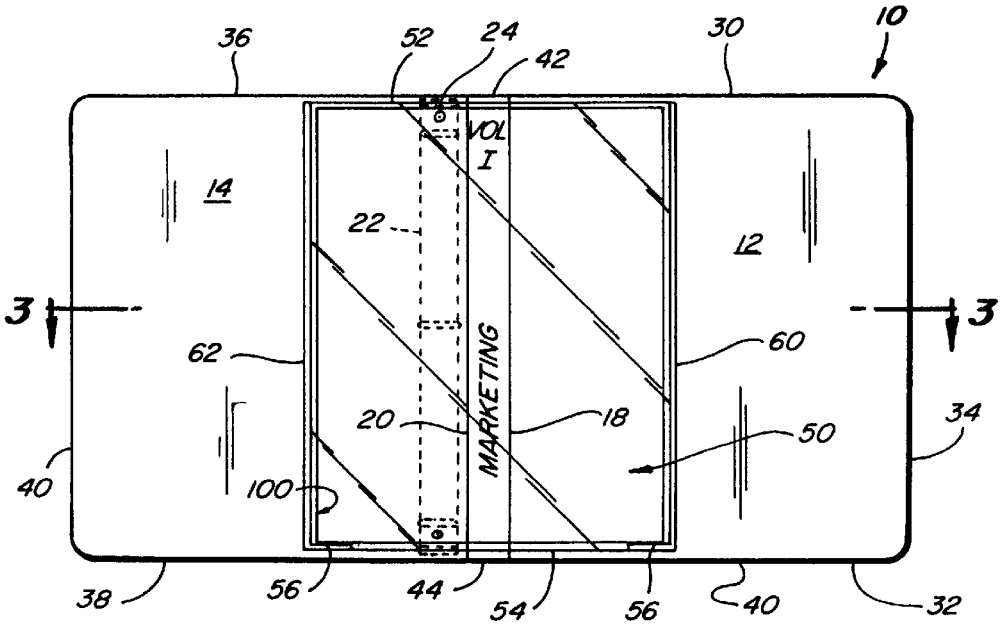
FIG. 2 is an elevational view of the outside of the binder showing, in an open position, the attachment of the label holder and the inserted label.

Referring now by reference numerals to the drawings and first to FIGS. 1 and 2 it will be understood that the binder, generally indicated by numeral 10, includes a front cover 12, a rear cover 14, and a spine 16 interconnecting said front and rear covers at fold lines 18 and 20. In the embodiment shown, the binder 10 is a three-ring binder having an offset, conventional ring assembly 22 attached as by rivets 24 to the rear cover 14. However, it will be understood that this arrangement is merely exemplary and the ring assembly 22 could be attached to the spine 16, as is also conventional. As best shown in FIG. 2, the binder front cover 12 is defined by upper and lower margins 30 and 32, side margin 34 and fold line 18. The rear cover 14 is defined by upper and lower margins 36 and 38, side margin 40 and fold line 20. The spine 16 is defined by upper and lower margins 42 and 44 and fold lines 18 and 20. In the embodiment shown in FIG. 4, the binder covers 12 and 14 and the spine 16 are unitarily formed from single ply plastic material, such as high density polyethylene sheet, having compression fold lines. A sheet thickness of about 0.05 inches has been found to be suitable. However, the binder covers and spine could also be formed from laminated material such as two plies of plastic having a cardboard or chipboard core sandwiched therebetween, or by any other conventional construction.

Importantly, the binder 10 includes a label holder 50 which, in the embodiment shown, is formed from a single sheet of transparent plastic material such as polyethylene film and a thickness of about 0.015 inches has been found to be suitable. The label holder 50 provides a pocket for a label 100, which can be of paper or the like, and which carries imprinted information relating to the contents of the binder 10. In the embodiment shown, the label holder 50 extends beyond and wraps around the spine 16 and is substantially the same height as the binder covers and spine. The label holder 50 includes an upper margin 52, which is generally free of attachment to the front and rear covers 12 and 14 and the spine 16; a lower margin 54, which in the embodiment shown, is generally free of attachment to the front and rear covers 12 and 14 and the spine 16 except for short portions, such as end portions indicated by numerals 56, which are attached to the front and rear covers 12 and 14 respectively, and side margins 60 and 62, which may be attached for their full length to the front and rear covers 12 and 14 respectively.

Figure 3:
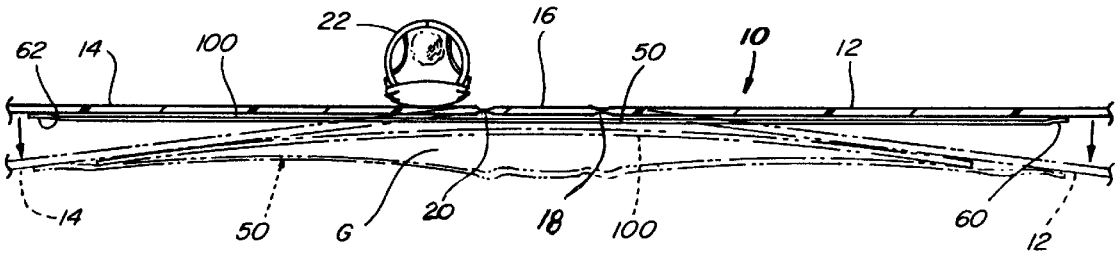
FIG. 3 is a cross-sectional view taken on line 3—3 of FIG. 2.

The structural arrangement of parts described above provides that the label 100 need be only slightly narrower in width than the dimension between the label holder attached side margins and may be readily slipped into place with the binder 10, when the binder is in an open condition. As shown in FIG. 3, in phantom outline, a gap G is created between binder front and rear covers 12 and 14 and spine 16 and the holder 50 when the covers 12 and 14 are flexed beyond 180° alignment. Because the label holder is free from attachment to the binder in the vicinity of the fold lines 18 and 20 defining the spine 16, there is no obstruction to the label 100 being slipped into place in wrap-around relation to the spine. The short lower margin end portions 56 provide a stop means which engage the label 100 and prevent it from exiting inadvertently from the bottom of the holder 50.

In the preferred embodiment, the material of the binder front and rear covers 12 and 14 and the spine 16 and the material of the label holder 50 are compatible so that the attachment of the holder sheet material along the side margins and lower margins may be by heat seals.

Figure 5:
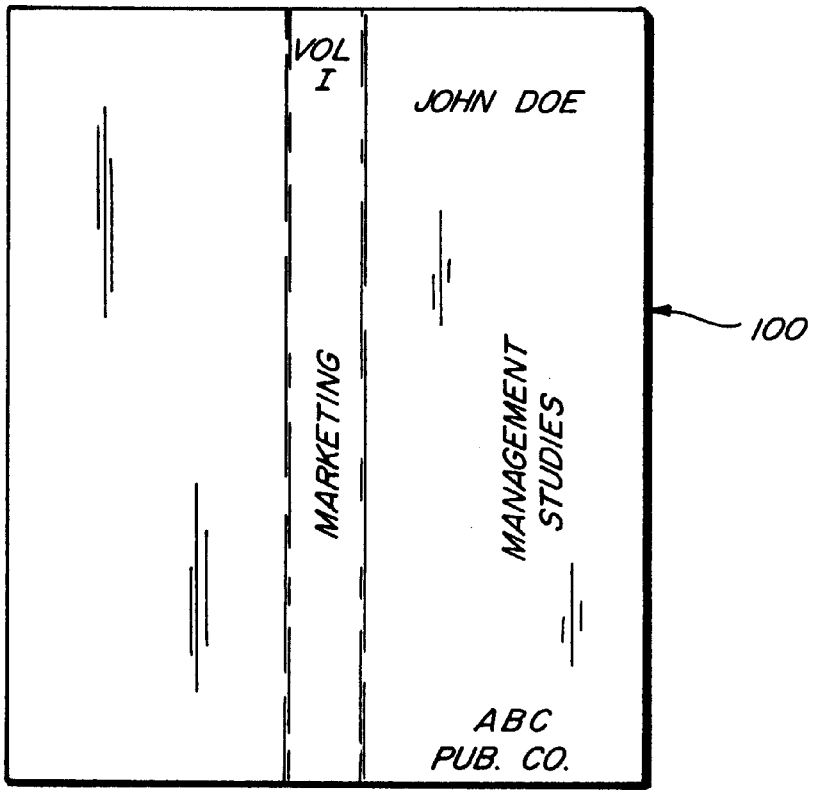
FIG. 5 is an elevational view of the label.

A particular advantage of the arrangement described is that it allows the use of conventional typing size paper such as 8½ inches by 11 inches to be used for the label 100 which, as shown in FIG. 5, facilitates considerably the provision of informational indicia on the label and allows the use of computer customized copy which cannot be achieved with smaller label sizes which cannot be run through a computer printer.

Figure 4:
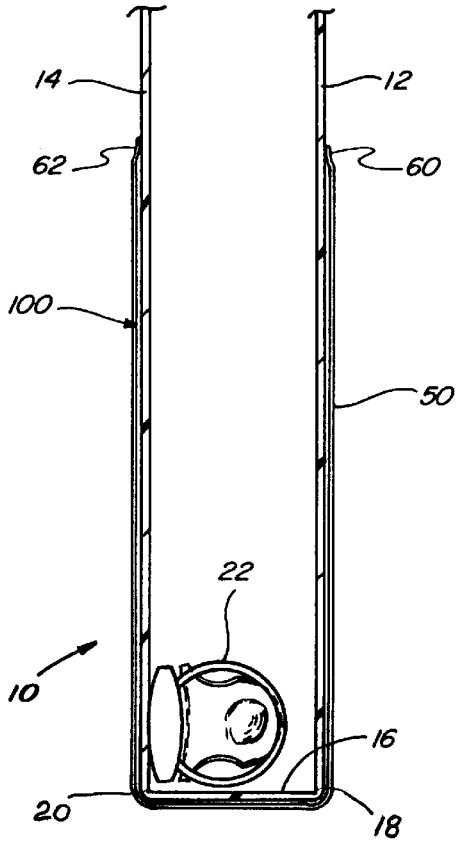
FIG. 4 is a cross-sectional view similar to FIG. 3, but with the binder in a closed condition.
Figure 6:
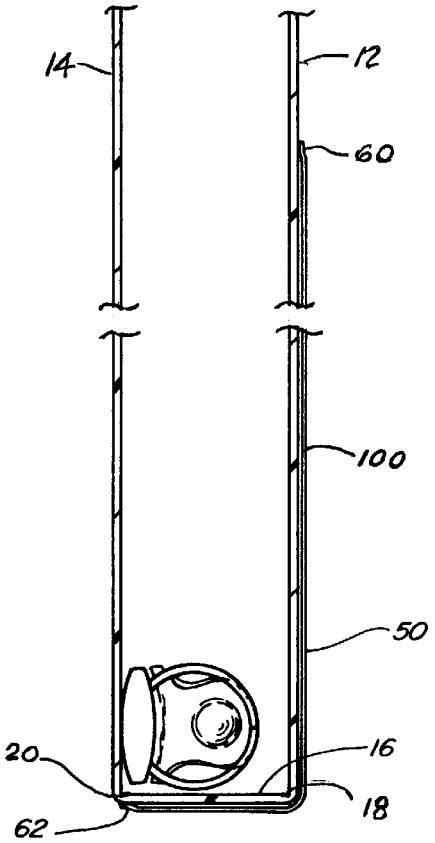
FIG. 6 is a similar view to FIG. 4 showing a modified holder.

The label holder 50 has been shown essentially symmetrically arranged as in FIG. 4, in which the label holder 50 is free of attachment to the binder in the vicinity of both fold lines 18 and 20. However, it may be desirable to provide that a larger share of the label holder width be arranged on the front cover 12 and the spine 16 as opposed to the rear cover 14 and this is easily achieved by making the distance from the label holder side margin 60 to the fold line 18 considerably greater than the distance from the label holder side margin 62 to the fold line 20. In both cases the label holder 50 is free of attachment to the spine 16 in the vicinity of the fold lines 18 and 20. Alternatively, in a modified arrangement shown in FIG. 6, the side margin 62 may be attached to the spine 16 in the vicinity of the fold line 20 but is free of attachment to the binder in the vicinity of the fold line 18.

Figure 7:
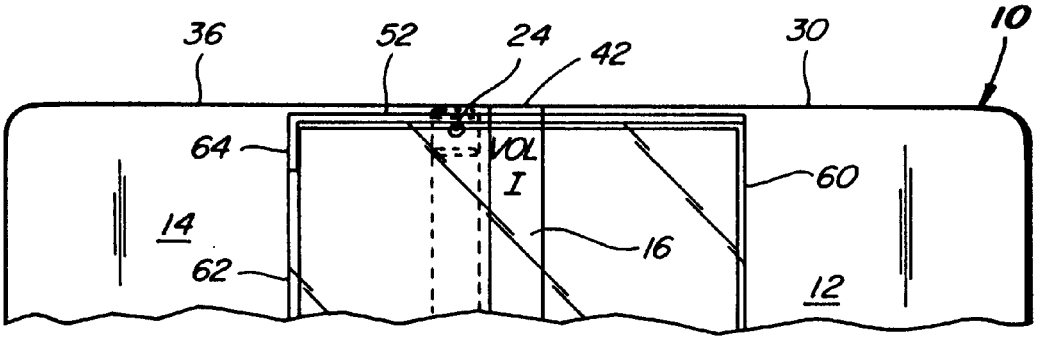
FIG. 7 is a similar view to FIG. 2 showing a modified holder attachment.

Also, within the scope of the invention, and as shown in FIG. 7, it may be desirable in some instances to attach the upper and lower margins 52 and 54 to the covers and leave at least one of the side margins, for example margin 60, open so that the label can be inserted from the side rather than from the top. In this case the end portions 64 of margin 60 may be closed to provide a stop means.

Although the binder has been described by making detailed reference to a preferred embodiment, such detail is to be understood in an instructive rather than in any restrictive sense, many other variants being possible within the scope of the claims hereunto appended.

I claim as my invention:

1. Binder with label holder comprising:

(a) a front cover, a rear cover and a spine connecting said front and rear covers and defined by fold lines; and (b) a holder including a sheet of transparent material having an upper margin, a lower margin and opposed side margins and a width less than total width of the front cover, the rear cover and the spine;

(c) at least one of said holder side margins being attached to one of said covers and the other of said side margins being attached to said spine, the holder being substantially free of attachment to the binder in the vicinity of at least one of said fold lines and at least one of said upper and lower margins being open to receive a label.

2. A binder as defined in claim 1, in which:

(d) said upper margin is open to receive a label having, a width greater than the width of the spine.

3. A binder as defined in claim 1, in which:

(d) said lower margin is at least partially attached to at least one of said covers to provide a stop for said label.

4. A binder as defined in claim 1, in which:

(d) said label is of a conventional paper size.

5. A binder as defined in claim 1, in which:

(d) the binder is of a size to receive a conventional size of paper and the label is the same size as said binder paper.

6. A binder as defined in claim 1, in which:

(d) the binder is polyethylene and the sheet of transparent material is polyethylene film having the side margins attached to the front cover and one of said rear cover and spine in the vicinity of the fold line between said rear cover and spine by heat sealing.

7. Binder with label holder comprising:

(a) a front cover, a rear cover and a spine connecting said front and rear covers and defined by fold lines, said covers and spine being of heat sealable material and having the same height the covers each having side margins;

(b) a holder including a sheet of transparent heat sealable material having an upper margin, a lower margin and opposed side margins and a width less than the total width of the front cover, the rear cover and the spine; and (c) said holder upper and lower margins being spaced apart a distance substantially equal to the height of the covers, and one of said holder side margins being heat sealingly attached to the spine and the other of said side margins being spaced from the spine and spaced from the side margin of said front cover a distance at least equal to the width of the spine, and being heat sealingly attached said cover, said upper margin being substantially free of attachment and said holder being substantially free of attachment to the binder in the vicinity of the fold lines to provide said holder with a label receiving open end, and said lower margin being at least partially heat sealingly attached to associated covers to provide a label engaging stop.

8. A ring binder with label holder comprising:

(a) a front cover, a rear cover and a spine connecting said front and rear covers and defined by fold lines; and (b) a holder including a sheet of transparent material having an upper margin, a lower margin and opposed side margins and a width less than total width of the front cover, the rear cover and the spine;

(c) at least one of said holder side margins being attached to said front cover and the other of said side margins being attached to said spine in the vicinity of the fold line between the rear cover and spine, the holder being substantially free of attachment to the binder in the vicinity of the fold line between the front cover and the spine;

(d) said upper margin being open to receive a label having a width greater than the width of the spine; and (e) said lower margin being at least partially attached to at least one of said front cover and spine to provide a stop for said label.

9. A ring binder as defined in claim 8, in which:

(f) the binder is of a size to receive a conventional 8½"×11" paper and the label is the same size.

10. A ring binder with label holder comprising:

(a) a front cover, a rear cover and a spine connecting said front and rear covers and defined by fold lines; and (b) a holder including a sheet of transparent material having an upper margin, a lower margin and opposed side margins and a width less than total width of the front cover, the rear cover and the spine;

(c) at least one of said holder side margins being attached to said front cover and the other of said side margins being attached to one of said spine and rear cover closely adjacent the fold line between said rear cover and said spine, the holder being substantially free of attachment to the binder in the vicinity of the fold line between the front cover and the spine;

(d) said upper margin being open to receive a label having a width greater than the width of the spine; and (e) said lower margin being at least partially attached to one of said front cover and spine to provide a stop for said label.

11. A ring binder with label holder comprising:

(a) a front cover, a rear cover and a spine connecting said front and rear covers and defined by fold lines; and (b) a holder including a sheet of transparent material having an upper margin, a lower margin and opposed side margins and a width less than total width of the front cover, the rear cover and the spine;

(c) at least one of said holder side margins being attached to said front cover and the other of said side margins being attached to the binder substantially at the fold line between said rear cover and spine, the holder being substantially free of attachment to the binder in the vicinity of the fold line between the front cover and the spine;

(d) said upper margin being open to receive a label having a width greater than the width of the spine; and (e) said lower margin being at least partially attached to at least one of said front cover and spine to provide a stop for said label.

* * * * *